United States Patent [19]

Pollard

[11] Patent Number: 4,873,734

[45] **Date of Patent: * Oct. 17, 1989**

[54] BUMPER SHEET

[76] Inventor: Dianne J. Pollard, 69 Jackson Way, Alamo, Calif. 94507

[ * ] Notice: The portion of the term of this patent subsequent to Aug. 26, 2003 has been disclaimed.

[21] Appl. No.: 214,084

[22] Filed: Jul. 1, 1988

Related U.S. Application Data

[63] Continuation-in-part of Ser. No. 878,292, Jun. 25, 1986, Pat. No. 4,754,509, which is a continuation of Ser. No. 723,109, Apr. 15, 1985, Pat. No. 4,607,402.

[51] Int. Cl.[4] ..... A47C 21/08

[52] U.S. Cl. ..... 5/425; 5/485

[58] Field of Search ..... 5/485, 482, 425, 424, 5/427, 474, 452

[56] References Cited

U.S. PATENT DOCUMENTS

| | | | |
|---|---|---|---|
| 429,494 | 6/1890 | Doremus | 5/485 |
| 1,343,881 | 6/1920 | Christensen | 5/485 |
| 2,217,819 | 10/1940 | Rook et al. | 5/485 |
| 2,462,780 | 2/1949 | Schiller | 5/485 |
| 2,586,031 | 2/1952 | Hahne . | |
| 2,644,173 | 7/1953 | James | 5/425 |
| 2,880,428 | 4/1959 | Forsland | 5/434 |
| 3,148,388 | 9/1964 | Esperson . | |
| 3,339,544 | 9/1967 | Kravitz | 128/80 |
| 3,638,251 | 2/1972 | Weiss . | |
| 3,803,646 | 4/1974 | Newerowski | 5/93 R |
| 3,924,282 | 12/1975 | Bond | 5/431 |
| 4,064,576 | 12/1977 | Threatt . | |
| 4,173,048 | 11/1979 | Varaney | 5/436 |
| 4,286,344 | 9/1981 | Ikeda | 5/424 |
| 4,334,331 | 6/1982 | Santo | 5/452 |
| 4,754,509 | 7/1988 | Pollard | 5/485 |

FOREIGN PATENT DOCUMENTS

| | | | |
|---|---|---|---|
| 1503577 | 12/1967 | France . | |
| 253404 | 6/1926 | United Kingdom | 5/485 |
| 868320 | 5/1961 | United Kingdom | 5/427 |
| 927094 | 5/1963 | United Kingdom . | |

*Primary Examiner*—Alexander Grosz

*Attorney, Agent, or Firm*—Philip A. Dalton

[57] ABSTRACT

A bumper sheet includes an array of pockets in which relatively soft yet form-retaining inserts (such as foam plastic cylinders or inflatable bladders) are removably fitted to define a bumper area enclosing a sleeping or rest area within the confines of a crib, bed rails or the like.

9 Claims, 1 Drawing Sheet

BUMPER SHEET

This is a continuation-in-part of my co-pending, allowed U.S. patent application, Ser. No. 878,292, filed June 25, 1986 now U.S. Pat. No. 4,754,509, which itself is a continuation of Ser. No. 723,109, filed Apr. 15, 1985, now U.S. Pat. No. 4,607,402, issued Aug. 26, 1986, both of which are incorporated by reference herein in their entirety.

BACKGROUND OF THE INVENTION

The present invention relates to bed-type restraints and, in particular, to a removable bumper restraint which is incorporated into a covering or sheet used in a crib or other bed-type restraint having surrounding rails or slats or the like, for preventing children or the infirm (or even animals or inanimate objects) from getting stuck or injured by the restraining slats or rails.

Permanently mounted or removable rail or bar restraints are widely used to prevent children or the incapacitated from falling out of bed. Such restraints are available in several forms, including longitudinal side bars which are part of, or are permanently mounted to the bed frame itself. Also, there are available rail assemblies, comprising side rails mounted on uprights, which can be removably mounted or clamped to the bed frame or inserted between the frame and the mattress. Restraints for the incapacitated are typified by hospital beds incorporating metal side rails which can be pivoted to a horizontal or down position to permit getting into and out of the bed and to facilitate changing bed clothes and administering to the patient. Restraints also take the form of baby cribs and the like.

In general, however, such restraints may allow the head, arms and/or legs to be inserted through the component members such as slats. One approach for reducing this danger uses what we here term "bumper strips". Typically, these are thin, padded strips covered with fabric or plastic which are positioned along the inside of the crib on top of the mattress and are tied to the crib. Despite this tie down fastening, bumper strips may still permit the insertion of head, arms and legs between the mattress and the bumper strip itself and between the crib slats.

SUMMARY OF THE INVENTION

In view of the above discussion, it is one object of the present invention to provide a combined sheet and bumper for cribs and other bed-type structures which is easily removed from the crib and, when positioned in the crib, permits ease of access to the occupant.

It is another object of the present invention to provide a crib bumper sheet which is not dedicated to a particular crib or structure, but is readily adaptable to and transferable between, different cribs.

These and other objects are attained in my bumper sheet invention which, in one aspect, comprises a bed covering or sheet containing elongated pockets along one or more of the sides, head and foot, which receive removable relatively rigid inserts, typically cylindrical (which includes polygonal), formed, e.g., of polystyrene foam or inflated bladders.

In another aspect, the inserts and pockets are configured in an overlapping, self-locking arrangement in which the inserts abut one another and thereby cooperatively retain one another in position.

BRIEF DESCRIPTION OF THE DRAWINGS

The above and other aspects of my invention are described in conjunction with the drawings in which.

DETAILED DESCRIPTION OF THE PREFERRED EMBODIMENT(S)

Figure 1:
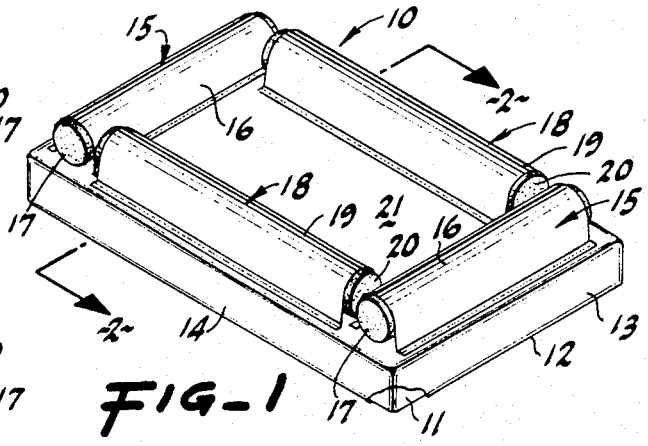
FIG. 1 is a perspective view of my fitted bumper sheet in position on a mattress.

FIG. 1 is a perspective representation of one embodiment 10 of the bumper sheet of my present invention, fitted to a mattress 11. The illustrated embodiment includes a fitted sheet 12, but is quite obviously adapted to non-fitted sheets as well. The fitted sheet 12 includes end panels 13 and side panels 14 which are designed to closely fit the associated contours of the mattress 11. Typically, the sheet 12 includes an elastic border or hem on the end and side panels (not shown) which retains the sheet on the mattress 11.

Figure 5:
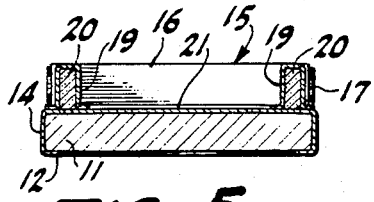
FIG. 5 is an end view of an alternative embodiment of the bumper sheet of FIG. 1 which has relatively thin, elongated upright bumper inserts.

Along both ends and both sides of the sheet 12 are bumpers 15 and 18 (also called bumper assemblies). The bumpers are formed by pockets which are dimensioned to receive cylindrical components or inserts. The inserts can be formed of relatively rigid material such as polystyrene foam cylinders or, preferably, are inflatable bladder cylinders. The inflatable bladders can be formed as one or more longitudinally-extending chambers. As used here, "cylindrical" and "cylinder" include various crosssection configurations, including but not limited to, circular, ovular and polygonal cross-sectional configurations and, preferably, inserts of elongated, thin rectangular cross-sections such as the inserts 20, FIG. 5.

Figure 2:
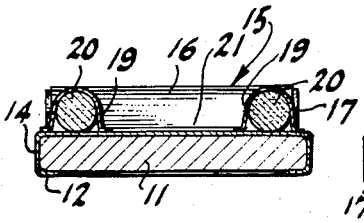
FIG. 2 a sectional view of the bumper sheet of FIG. 1 taken in the direction of arrows 2—2.
Figure 4:
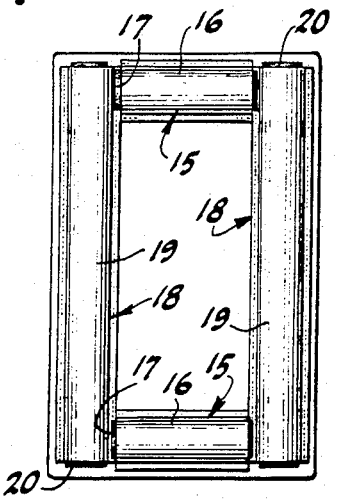
FIG. 4 is a schematic representation of an alternative four-bumper self-locking arrangement.
Figure 3:
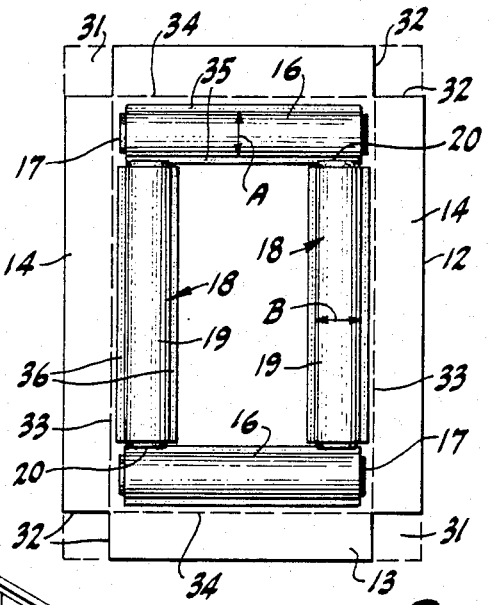
FIG. 3 is a plan view of the sheet and bumper structure of FIG. 1, shown with the sheet laid flat.

Referring also to FIGS. 3 and 4, the bumpers form a rectangular configuration in which the base and head comprise bumper assemblies 15 having pockets 16 and associated inserts 17 at the foot and head of the bed. The sides of the rectangular configuration are defined by the longitudinally-extending bumper assemblies 18, each of which comprises a pocket 19 and an associated insert 20. See also FIGS. 2 and 5. The pocket structures 15 and 18 thus define an enclosed, rectangular-shaped resting or sleeping area.

My bumper sheet has a number of advantages over conventional bar, rail and mattress retainers and over the standard tie-down bumpers. For example, the cylindrical plastic or bladder units 17 and 20 can be removed to permit laundering and cleaning (and in the case of the inflatable bladders can be deflated for ease of transport and storage) but, when in place, provide soft yet firm barriers which retain the occupant on the mattress. The bumper sheet 10 can be formed in the various standard crib sheet and bed sheet sizes and used interchangeably on different mattresses or beds. Also, the same bumper sheet 10 can be used in situations which require a bed or mattress restraint to prevent someone who is ill or otherwise incapacitated from falling off the bed, as well as to retain a child in bed once the child is moved from a crib to a regular bed.

A plan view of my four-sided bumper sheet 10 is shown in FIG. 3. The sheet comprises a rectangle of cloth or other material and includes end panels 13—13 and side panels 14—14. In the fitted embodiment, the sheet typically has sections such as 31 removed and is joined along the ends 32 to provide a shape which conforms to the contour of the mattress 11 (FIG. 1). The side bumpers or bumper assemblies 18 extend at or adjacent to the longitudinal edges 33 of the top side 21 of the sheet. Similarly, the head and foot bumper assemblies 15 extend generally at or adjacent the end edges 34 of the sheet. The actual width of the rectangular strips of pocket material is greater than the distances A and B between the stitch lines 35—35 and 36—36 to accommodate the inserts 17 and 20 (FIG. 1). Preferably, in an easily manufacturable arrangement, which is durable and easily removed for washing, storage, etc., the pockets 16 and 19 are rectangular strips of material which are attached to the sheet 12 by sewing. The lines of stitching join the pockets to the sheet along the outer edges of the pocket material, as illustrated schematically by the stitch lines 35 and 36 in FIG. 3. However, other means of attachment including, but not limited to, hook and loop-type fasteners such as the ones sold under the trade name VELCRO TM or water-resistant releasable adhesive could be used. In general, however, such alternative fastening approaches are less desirable than sewn stitches because they do not provide the same combination of impenetrability (discussed below), durability and integrated smooth, bump-free construction.

Friction between the relatively long side pockets 19 and end pockets 16 and their associated inserts has proven sufficient to retain the inserts in the pockets. Nonetheless, the bumpers can be readily configured and located to provide a self-locking arrangement where such is desired. Thus, referring to FIG. 3, in the illustrated, totally enclosed four-sided sheet bolster structure, the inner sides of the opposite ends of the bumpers 15 abut or are closely adjacent to the ends of the side bolsters 18. Typically, the side inserts 20 are inserted first, then the end inserts are inserted. The side inserts 20 slightly overlap the end bumpers 15. As a result, the end bumpers 15 block the side inserts 20 and, thereby, keep the side inserts from moving. In addition, the side inserts 20 press against the end bumpers 15 slightly and prevent the end inserts 17 from moving.

FIG. 4 depicts another four-sided self-locking arrangement in which the side bumpers 18 overlap the end bumpers 15. This arrangement is functionally the reverse of the overlapping end bumper arrangement shown in FIGS. 1 and 3. That is, in the FIG. 4 arrangement the side bumpers 18 block the end inserts 17, while, in pressing against the side bumpers, the end inserts 17 prevent the side inserts 20 from moving.

It should be noted that the self-locking arrangement is not limited to four-sided configurations. For example, a three-sided, U-shaped bumper configuration can be formed by deleting one of the end or side bumpers from the four-sided configuration shown in FIGS. 3 or 4.

Figure 6:
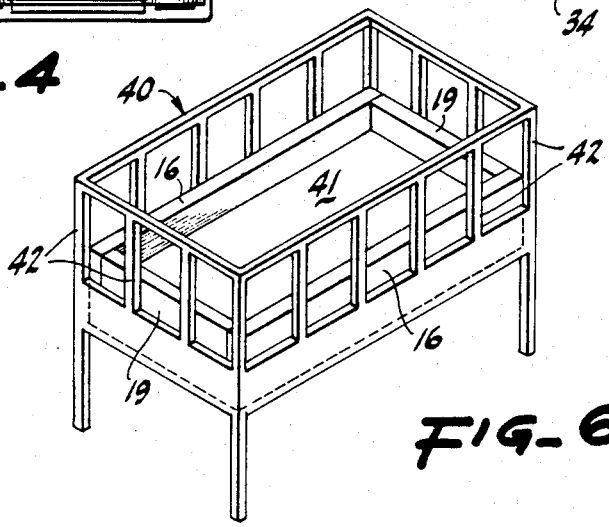
FIG. 6 is a perspective view of my bumper sheet shown in position on a mattress within a crib.

More generally, one, two, three, four or more bumpers can be incorporated into a sheet along the sides thereof which are adjacent to restraints such as crib slats 42, FIG. 6, or bed rails. The sheet can also incorporate bumpers along the sides thereof which do not have adjacent rails or slats, for example, along the head and foot of a bed which has only side rails. In one particularly useful embodiment, the pockets are provided along all the edges of the sheet (e.g., along the foot, head, and sides), inserts are provided for all the pockets and one or more or all of the inserts are used, as desired.

FIG. 6 depicts my bumper sheet 10 in use on a mattress 41 in a crib 40 having spaced vertical slats 42 which are designed to prevent a person, typically a child, from falling out of or off the mattress. As mentioned, the bumper pockets 16 and 19 preferably are attached by stitching or the like along the entire length of the sides and ends of the mattress, thereby providing an impenetrable barrier against insertion of hands, legs, etc., between the bumpers and the mattress as well as through the bumper itself. This is in contrast to the previously mentioned standard tie-down bumpers which are not attached along the sheet, which can be deformed and moved relative to the sheet during use and which, therefore, do not provide the impenetrable yet relatively soft barrier afforded by my present invention.

Consider now two of the many possible examples of my bolster sheet, specifically circular cross-section bumper (bolster) and rectangular cross-section bumper examples of the rectangular bumper sheet configuration depicted in FIG. 4, based upon a 28 in.×52 in. crib sheet. Using the FIG. 4 configuration, the exemplary rectangular cross-section bumper inserts (FIG. 5) measure approximately ½ in. wide×4½–5 in. high×52 in. long (side inserts) and ½ in. wide×4½–5 in. high×27 in. long (end inserts). The exemplary circular cross-section inserts (FIG. 2) measure approximately 2 in. diameter×52 in. long (side inserts) and 2 in. diameter×24 in. long (end inserts). The cloth rectangles for the end pockets or sleeves and the overlapping side pockets are approximately the same size as the inserts to permit ready insertion and stability. All four cloth pockets preferably are attached to the sheet by sewing along the stitch lines with dimensions A and B being selected, as mentioned, to smoothly accommodate the inserts. The result is an enclosed, rectangular-shaped crib sleeping area defined by the bumpers, which prevent insertion of hands, arms, legs or head, etc., under the bumpers or between the slats of the crib.

With the illustrated open-ended pocket or sleeve configuration and, in addition, with the closely fitting intersecting rectangular configuration shown, for example, in FIGS. 3 and 4, it is easier to insert or remove the bumper inserts with the sheet off the bed, i.e., prior to putting the sheet on the bed or after taking the sheet off the bed. This has the desirable result of making it difficult for an infant or child in the crib to remove the bumper inserts.

In addition to, or instead of, the illustrated open-ended configuration, the pocket 16 and 19 can be formed with slit, flap or sleeve-type openings or other suitable openings along a section of the length thereof, preferably at the outside of the pocket. Such longitudinal openings facilitate insertion and removal of the bumper insert when the sheet is on the crib, but, desirably, it is difficult for a child or infant located in the crib to remove the bumpers via the outside slits.

Although various other embodiments of my retainer sheet have been described here, those of usual skill in the art will derive other embodiments, based upon the present disclosure, which are within the scope of the invention as claimed.

Having thus described various preferred and alternative embodiments, what is claimed is:

1. A bumper sheet for covering the top surface of a base such as a mattress within a secure rest area defined by structural members such as crib slats or bed rails for preventing a person or object resting on the mattress from falling off, the bumper sheet comprising:

a sheet of covering material selected from cloth and other flexible materials;

elongated pockets attached along all of the peripheral edges of the top surface of the base for providing a bumper restraint along the associated edge of the sheet and base, the individual pockets comprising a relatively narrow elongated strip of material selected from cloth and other flexible materials attached to the sheet substantially continuously along the length of the strip; and at least one form-retaining insert sized for removable insertion into an associated pocket;

the inserts and associated pockets forming a bumper of configuration defined by the configuration of the associated pockets, for providing a barrier against insertion of body members such as the hands and legs into said structural members.

2. The bumper sheet of claim 1, wherein the at least one insert is an inflatable bladder.

3. The bumper sheet of claim 1, wherein the at least one insert is a plastic cylinder.

4. The bumper sheet of claim 1, wherein the sheet comprises four top edges and wherein pockets are formed along the four top edges and inserts are fitted within all of the pockets.

5. The bumper sheet of claim 4, wherein the inserts are inflatable bladders.

6. The bumper sheet of claim 4, wherein the inserts are plastic cylinders.

7. A bumper sheet for covering the top surface of a base such as a mattress within a secure rest area defined by structural members such as crib slats or bed rails for preventing a person or object resting on the mattress from falling off, the bumper sheet comprising:

a sheet of material selected from cloth and other flexible materials;

a plurality of elongated pockets attached along the peripheral edge of the sheet in the region thereof corresponding to the top surface of the base and defining a generally rectangular-shaped restraint about a rest area of the sheet;

each pocket comprising a relatively narrow elongated strip of material selected from cloth and other flexible materials attached to the sheet substantially continuously along the length of the strip to thereby define a pocket;

elongated form-restraining inserts sized for removable insertion into the associated pockets; and the pockets and inserts forming a bumper configuration defined by the configutation of the associated pockets for providing a barrier against insertion of body members such as the hands and legs into said structural members.

8. The bumper sheet of claim 7, wherein the inserts are inflatable bladders.

9. The bumper sheet of claim 7, wherein the inserts are plastic cylinders.

* * * * *